US006471274B1

(12) United States Patent
Nerger

(10) Patent No.: US 6,471,274 B1
(45) Date of Patent: Oct. 29, 2002

(54) GRIPPER OF A LIFTABLE AND LOWERABLE LOAD-CARRYING APPARATUS FOR GRABBING CONTAINERS FROM ABOVE

(75) Inventor: Klaus Nerger, Neukirchen-Vluyn (DE)

(73) Assignee: Atecs Mannesmann AG, Düsseldorf (DE)

( * ) Notice: Subject to any disclaimer, the term of this patent is extended or adjusted under 35 U.S.C. 154(b) by 86 days.

(21) Appl. No.: 09/660,801

(22) Filed: Sep. 13, 2000

(30) Foreign Application Priority Data

Sep. 20, 1999 (DE) ..... 199 46 122

(51) Int. Cl.[7] ..... B66C 1/66
(52) U.S. Cl. ..... 294/81.54; 294/81.21
(58) Field of Search ..... 294/68.3, 81.1, 294/81.2, 81.21, 81.5, 81.53, 81.54, 82.24, 82.26, 82.35, 86.4, 87.26, 93, 119.1

(56) References Cited

U.S. PATENT DOCUMENTS

| | | | | |
|---|---|---|---|---|
| 2,597,128 A | | 5/1952 | Reinking | |
| 3,302,968 A | * | 2/1967 | Bleiman et al. | 294/119.1 X |
| 3,727,965 A | * | 4/1973 | Cranston et al. | 294/81.54 |
| 3,762,754 A | * | 10/1973 | Goyarts | 294/81.54 |
| 5,090,757 A | * | 2/1992 | Huber et al. | 294/119.1 X |
| 6,086,316 A | * | 7/2000 | Sundermeijer | 294/81.54 X |

FOREIGN PATENT DOCUMENTS

| | | |
|---|---|---|
| DE | 42 29 215 A1 | 3/1993 |
| DE | 42 29 346 A1 | 3/1993 |
| DE | 43 04 723 A | 8/1993 |
| DE | 295 16 996 U | 4/1996 |
| FR | 1 487 616 A | 10/1967 |

OTHER PUBLICATIONS

DE–Z: F + H Fördern und Heben 46 (1996) No. 7, p. 54.

* cited by examiner

*Primary Examiner*—Johnny D. Cherry
(74) *Attorney, Agent, or Firm*—Henry M. Feiereisen

(57) ABSTRACT

A gripper of a liftable and lowerable load-carrying apparatus for a container, includes a frame placed from above onto a container and having spaced-apart cross beams. Each cross beam defines a longitudinal direction and has at least two gripper elements spaced from one another at a distance which is greater than a dimension of the gripper elements, with each gripper element depending from the cross beam for insertion through a container opening when the frame is placed on the container. The cross beam is made of two sheets which are movable relative to one another in the longitudinal direction, with one of the sheets having one of the gripper elements and the other one of the sheets having the other one of the gripper elements, with the two gripper elements movable in opposite direction to one another in the longitudinal direction of the beam between a ready position and a gripping position.

14 Claims, 5 Drawing Sheets

GRIPPER OF A LIFTABLE AND LOWERABLE LOAD-CARRYING APPARATUS FOR GRABBING CONTAINERS FROM ABOVE

CROSS-REFERENCES TO RELATED APPLICATIONS

This application claims the priority of German Patent Application, Serial No. 199 46 122, filed Sep. 20, 2000, the subject matter of which is incorporated herein by reference.

BACKGROUND OF THE INVENTION

The present invention relates to a gripper of a liftable and lowerable load-carrying apparatus for grabbing containers from above.

German Patent No. 42 29 215 A1 discloses a gripper for grabbing loads from above. The gripper includes a frame composed of longitudinal beams and interconnecting cross beams and is connected to a hoist via an eyelet. Disposed on each of the cross beams is a pair of gripper elements which are spaced from one another at a distance substantially corresponding to the length of the cross beam. As a consequence, the distance between the gripper elements is great in relation to the dimensions of the gripper elements with respect to width, length, and thickness. Each gripper element has two hook members positioned in a common vertical plane and including hook ends facing away from one another. The hook ends adjacent areas of both hook members are in confronting relationship and adjoin one another, when the gripper element is in its ready position. The gripper elements extend vertically downwards and engage in complementary container openings, when the frame is placed upon the container, whereby the container openings have a slotted configuration in the sidewall of the container. This conventional gripper is predominantly intended for use with standardized containers with open top and vertical sidewalls that have in the upper rim zone the container openings which extend into the sidewall. The hook members of each gripper element are pushed apart into a gripping position by a rod assembly for grabbing behind the rim of the slotted opening.

A drawback of this conventional gripper is its relatively complex structure and the need to assemble many single components.

German Pat. No. DE 42 29 346 describes a vertically adjustable gripper for system containers, having two cross beams which each have a pair of gripper elements that are movable transversely to the lift direction.

SUMMARY OF THE INVENTION

It is thus an object of the present invention to provide an improved gripper, obviating the afore-stated drawbacks.

In particular, it is an object of the present invention to provide an improved gripper which is simple in structure and comprised of only few individual parts that are cost-efficient to fabricate, and yet is reliable in operation.

These objects, and others which will become apparent hereinafter, are attained in accordance with the present invention by providing a frame placed from above onto a container and having spaced-apart cross beams, each cross beam defining a longitudinal direction and having at least two gripper elements spaced from one another at a distance which is greater than a dimension of the gripper elements, with each gripper element depending from the cross beam for insertion through a container opening when the frame is placed on the container, said cross beam being made of two sheets which are movable relative to one another in the longitudinal direction, with one of the sheets having one of the gripper elements and the other one of the sheets having the other one of the gripper elements, with the two gripper elements movable in opposite direction to one another in the longitudinal direction of the beam between a ready position and a gripping position.

In accordance with the present invention, each cross beam has thus at least a pair of gripper elements, whereby each pair of gripper elements is linearly movable in opposition to one another in longitudinal direction of the cross beam. Thus, each cross beam has at least two gripper elements spaced from one another at a relatively great distance. The gripper elements, e.g., mounted to a carrier element, are moved into the gripping position by respectively linearly shifting the carrier elements until the gripper elements engage underneath the respective holding elements on the container. For grabbing, the gripper elements of each pair are displaced until bearing upon the edges of the container opening. This configuration is simple in construction and requires only a small number of individual components.

According to the present invention, each cross beam is made of two sheets which are movable in the longitudinal direction, wherein one of the sheets has one of the gripper elements and the other one of the sheets has the other one of the gripper elements, with the two gripper elements movable in opposite direction to one another in the longitudinal direction of the cross beam. Thus, the sheets can be advantageously manufactured in almost any contour in a simple and cost-efficient manner.

The construction of the gripper can be further simplified when the length of the cross beam is variable by adjusting the two sheets relative to one another in synchronism for moving the gripper elements between the gripping and ready positions. The gripper elements are hereby securely fixed to the cross beams.

To ensure the displacement of the sheets in the longitudinal direction, it is proposed to provide each of the sheets with a circular opening for receiving a bolt in a direction transversely to the longitudinal direction, and with an elongate hole spaced from the opening in longitudinal direction, with the bolt received in the opening of one of the sheets engaging the elongate hole of the other one of the sheets. In this manner, the guidance in the longitudinal direction is easy to make while yet reliable in operation.

A more secure grabbing operation by the gripper is realized when according to another feature of the present invention, each of the gripper elements is provided with two hook members, with one of the hook members located on one of the sheets and the other one of the hook members located on the other one of the sheets. Suitably, the hook members of each gripper element point away from one another, so that the hook members are able to grab from underneath the container opening on opposite side edges.

A reliable movement of the gripper elements from a spaced-apart disposition into an overlapping disposition can be ensured by overlapping the hook members of each gripper element with one another in a direction transversely to the longitudinal direction when the gripper element is in the gripping position and the hook members are moved apart. The displacement of the hook elements is thus restricted to an extent that prevents the formation of a gap between the hook elements in transverse direction when the hook members are pushed apart, and eliminates the risk that the hook members interlock.

According to another feature of the present invention, each of the sheets is formed in one piece with the hook member, suitably by cutting from sheet metal, in particular through a laser cutting process. In this manner, the manufacturing process is simplified.

To prevent a penetration of thin container walls, ribs or ridges between two hook members when the frame is incorrectly positioned upon the container, one of the hook members may have a lower end which is so configured as to cover a gap formed between the hook members. This may be realized by simply bending the lower end inwards and cutting this end at an angle so that an edge is created which covers the gap.

Suitably, the hook members of each gripper element so cover one another when pushing the hook member together, as viewed transversely to the longitudinal direction, as to form a downwardly tapered entry element for insertion into the container opening. In this manner, the insertion of the gripper elements into the container is simplified and reliable, and the gripper elements exhibit a hook-free shape.

According to another feature of the present invention, the longitudinal beams have ends, with the bolts arranged at the ends. The bolts may hereby be formed onto the ends of the longitudinal beams to simplify the overall construction.

In order to suit the gripper to containers of different width, the parallel longitudinal beams are each telescopically changeable in length.

According to another feature of the present invention, a movement of the hook members is ensured by rotatably attaching rollers to the bolts for placement on a rim of the container, thereby reducing the frictional resistance.

BRIEF DESCRIPTION OF THE DRAWING

The above and other objects, features and advantages of the present invention will be more readily apparent upon reading the following description of a preferred exemplified embodiment of the invention with reference to the accompanying drawing, in which.

DETAILED DESCRIPTION OF PREFERRED EMBODIMENTS

Figure 1:
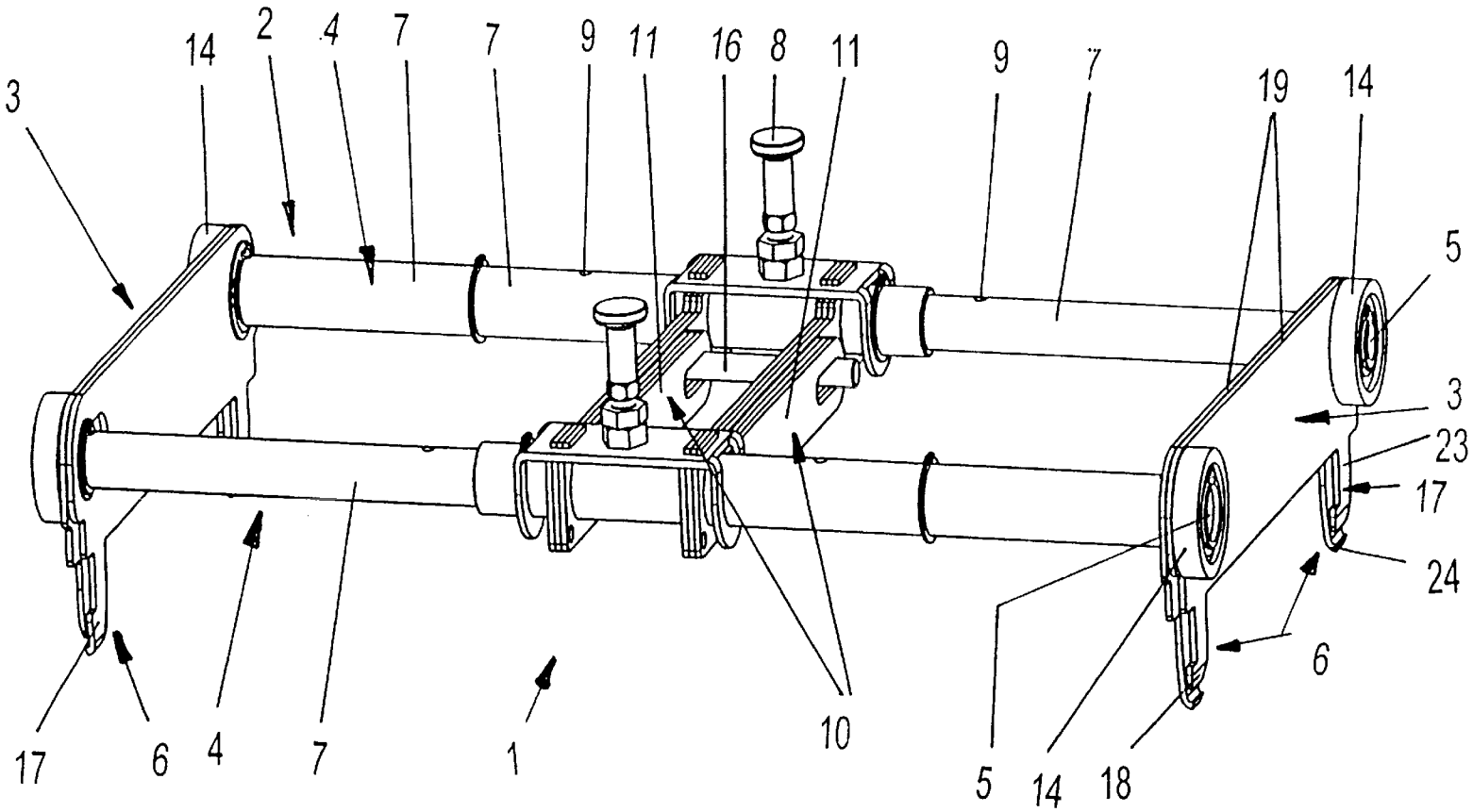
FIG. 1 is a perspective illustration of a gripper according to the present invention.

Throughout all the Figures, same or corresponding elements are generally indicated by same reference numerals.

Turning now to the drawing, and in particular to FIG. 1, there is shown a perspective illustration of a gripper according to the present invention, generally designated by reference numeral 1 and forming part of a height adjustable load-bearing apparatus for containers. The gripper 1 includes a frame, generally designated by reference numeral 2 and placed from above onto a container (not shown). The frame 2 is comprised of two parallel longitudinal beams 4 and two cross beams 3 for interconnecting the longitudinal beams 4 at their opposite axial ends. Each cross beam 3 has two gripper elements 6 which depend downwards at a distance to one another, with each gripper element 6 destined for engagement into a container opening, when the frame 2 is placed onto the container. The distance between the spaced-apart gripper elements 6 exceeds a greatest dimension of the gripper element 6, i.e. the distance between the gripper elements 6 is greater than the length, width and height of the gripper element 6. In the non-limiting example of FIG. 1, the distance between the gripper elements 6 is about six times the downwardly extending length of the gripper element 6.

Figure 2A:
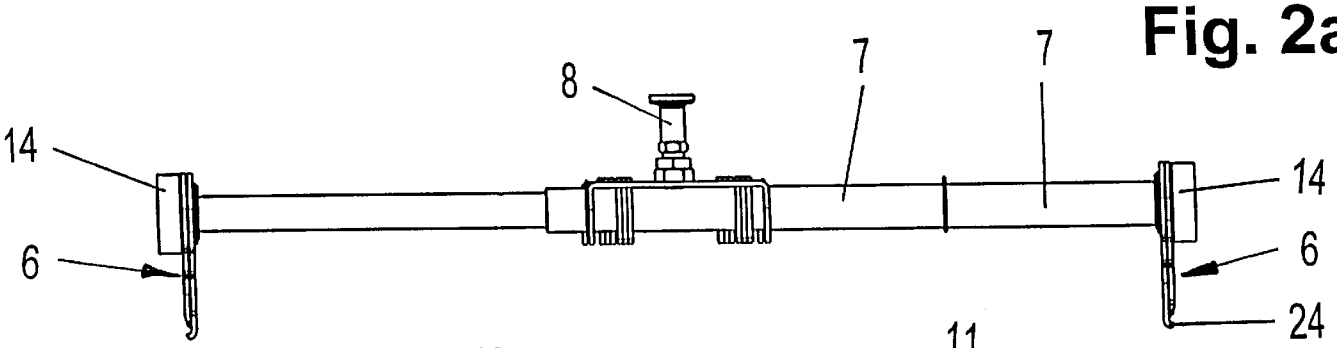
FIG. 2*a* is a side view of the gripper.
Figure 2B:
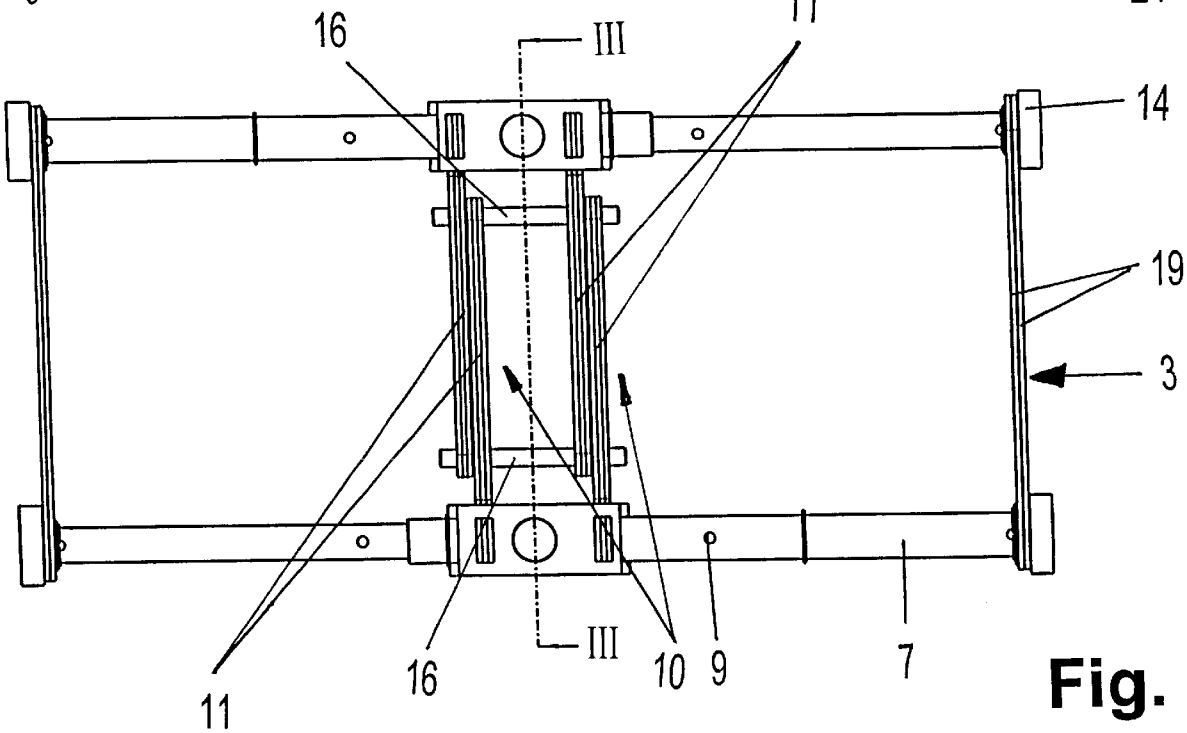
FIG. 2*b* is a top view of the gripper.

Both parallel longitudinal beams 4 are composed of a plurality of tubes 7 nested within one another so as to allow a telescopic adjustment of the longitudinal beams 4. Thus, the longitudinal beams 4 can be extended or reduced in length so that the frame 2 can be best suit to different container sizes. Locking members 8 are provided to secure the longitudinal beams 4 in position by engaging respective bores 9 in the tubes 7 of the longitudinal beams The longitudinal beams 4 terminate at their axial ends in bolts 5 which pass through the cross beams 3 to thereby attach the cross beams 3 to the longitudinal beams 4. Freely turning rollers 14 are secured from outside onto the ends of the bolts 5 for support on the rim of the container. Further interconnecting the longitudinal beams 4 are two bridges 10 which extend in parallel relationship transversely to the longitudinal beams 4. As shown in FIGS. 2*a* and 2*b*, each bridge 10 is comprised of two sets of three parallel sheet metal plates 11 which are securely fixed together and can be easily fabricated, e.g. by means of a laser cutting process. Persons skilled in the art will understand that the provision of three sheet metal plates 11 to establish a set is done by way of example only. Certainly, more or less than three such sheet metal plates for a set should be considered within the scope of the present invention.

As shown in particular in FIG. 2*b*, the two sets of sheet metal plates 11 of each bridge 10 are arranged offset to one another. At their longitudinal beam proximate end, each set of sheet metal plates 11 is provided with a through-opening 15 (FIG. 3) for passage of the longitudinal beams 4. The bridges 10 are secured in place by the locking members 8.

Figure 3:
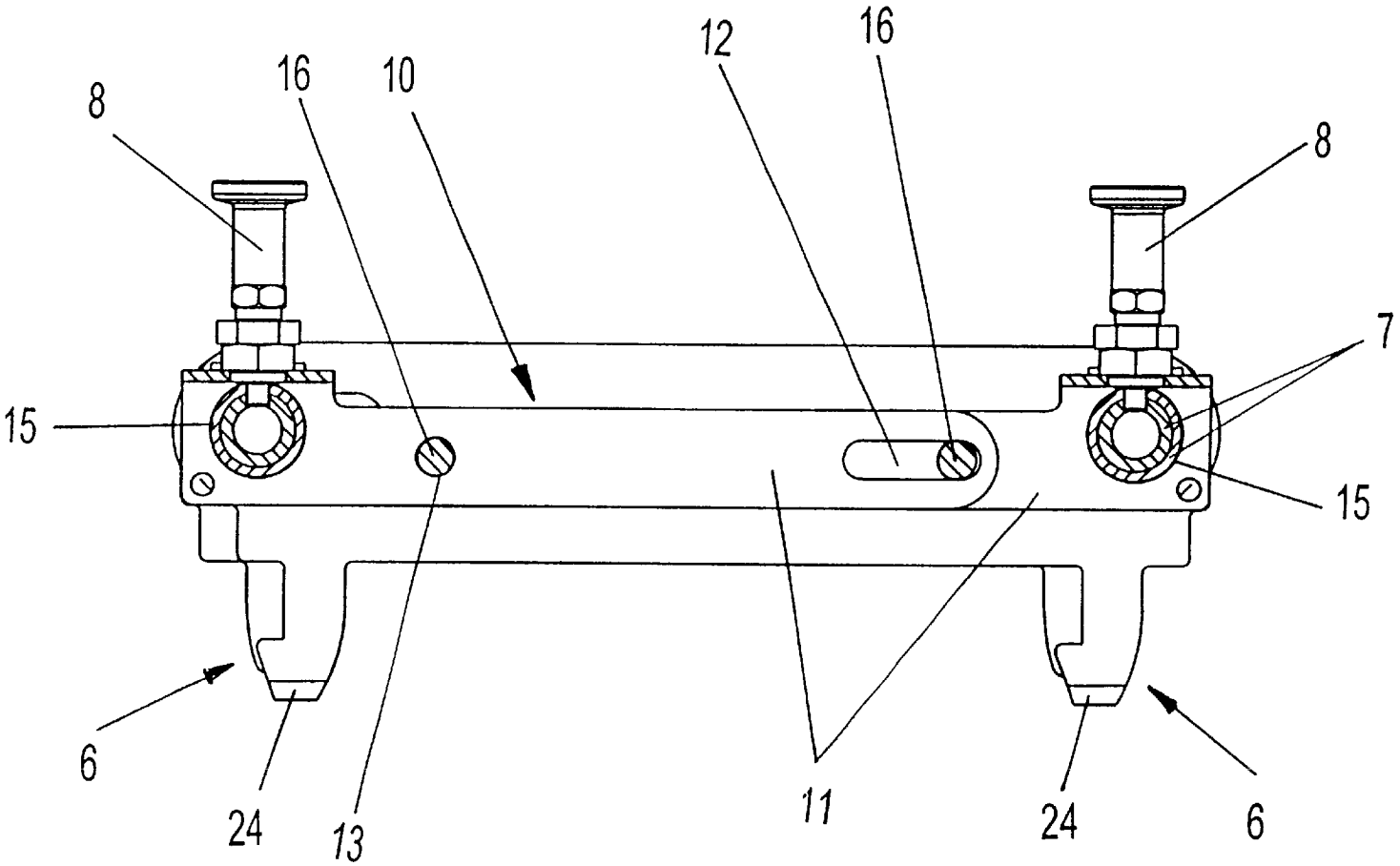
FIG. 3 is a sectional view of the gripper, taken along the line III—III in FIG. 2*b*.

Referring now to FIG. 3, which shows a sectional view of the gripper 1, taken along the line III—III in FIG. 2*b*, it can further be seen that the sheet metal plates 11 of each bridge 10 are formed with an elongate hole 12 and with a circular opening 13 at a distance to the elongate hole 12, whereby the elongate hole 12 of the sheet metal plates 11 of one set of the bridge 10 and the circular opening 13 of the sheet metal plates 11 of the other set of the bridge 10 are positioned in confronting disposition. Extending through the circular openings 13 of both bridges 10 and transversely to their longitudinal direction, i.e. in parallel relationship to the longitude longitudinal beams 4, are hinge bolts 16 which are suitably secured against displacement in axial direction. Thus, the two sets of sheet metal plates 11 of each bridge 10 are guided longitudinally by the elongate holes 12 and freely movable relative to one another.

Although not shown in the drawing, a parallel bars linkage is articulated to the underside of the hinge bolts 16 and to the top of a carrier unit (not shown) for pushing the parallel longitudinal beams 4, disposed in a horizontal plane, apart in synchronism by the weight of the carrier unit, when the gripper 1 is placed on the container.

Figure 4:
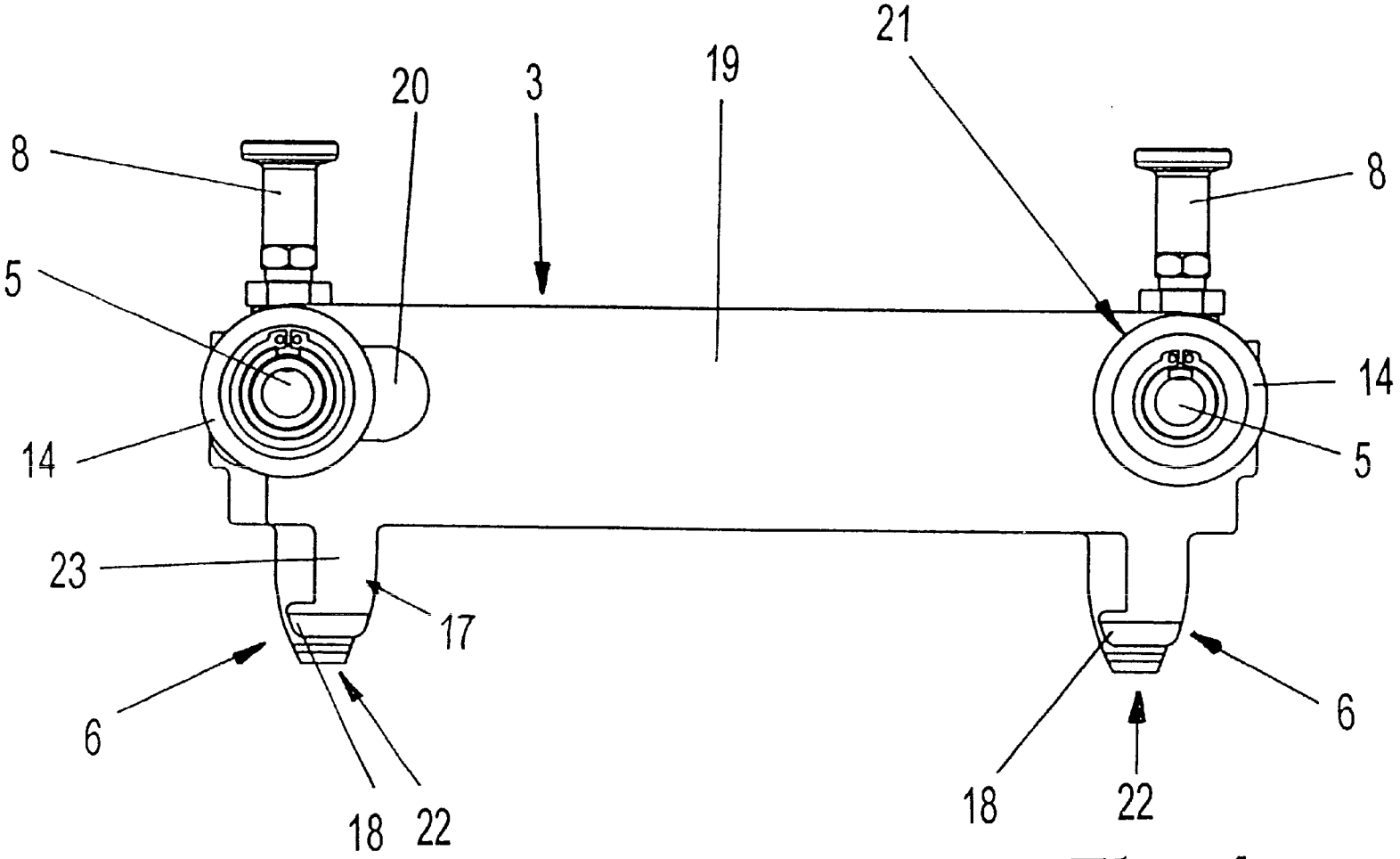
FIG. 4 is a side view of the gripper of FIG. 1 with the hook members pushed together.

FIG. 2*b* further shows that each cross beam 3 is made of two sheets 19 which can be manufactured in a simple manner by a laser cutting process. As best seen in FIG. 4, each cross beam sheet 19 has two spaced-apart hook members 17 with hook ends 18 that point in a same direction. A single-piece construction of the cross beam sheet 19 with the hook member 17 is advantageous as a stable structural component is realized which is easy to manufacture.

Analog to the sheet metal plates 11, each cross beam sheet 19 is provided with an elongate hole 20 and a circular opening 21 in spaced-apart relation in longitudinal direction, whereby the elongate hole 20 of one cross beam sheet 19 confronts the opening 21 of the other cross beam sheet 19. A relative displacement between the cross beam sheets 19 in the longitudinal direction is realized by guiding the bolts 5 of the longitudinal beams 4 transversely to the longitudinal extension of the cross beam sheets 19 through the aligned structures of opening 21 and elongate hole 20 on both sides of the cross beam 3, whereby the bolts 5 are received in fixed rotative engagement in the openings 21 and whereby the elongate hole 20 is positioned in one case in front and in the other case in the back. In FIG. 4 (and also in FIG. 5), the openings 21 are not visible as they are positioned behind and thus covered by the rollers 15. The two cross beam sheets 19 are interconnected to one another for longitudinal displacement at formation of a slight gap of about 0.1 mm between the cross beam sheets 19. A displacement of the sheets 19 in the direction of the longitudinal beams 4 can be prevented, for example, by placing a conventional locking ring in a radial groove at the end of each longitudinal beam 4.

Figure 5:
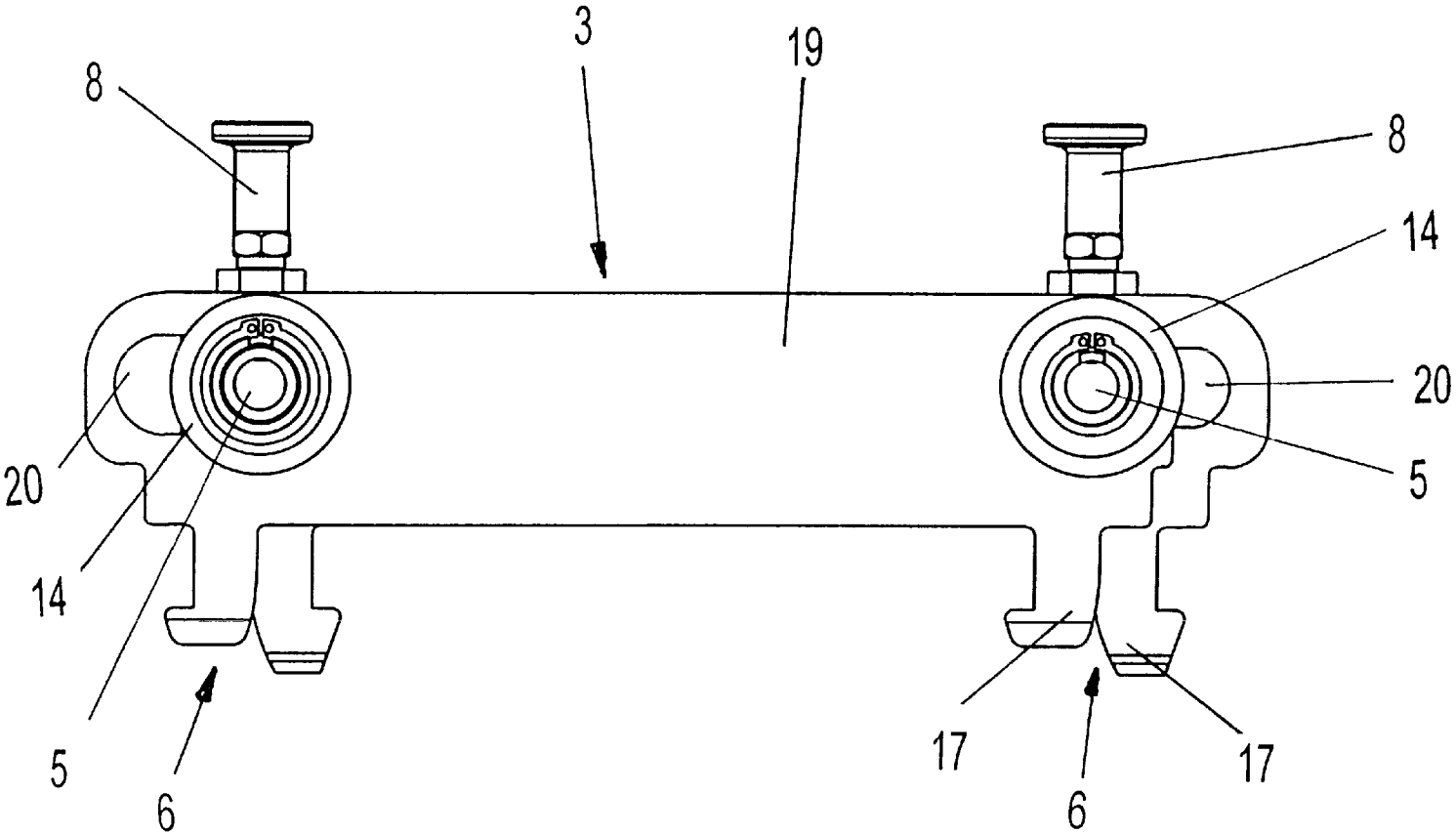
FIG. 5 is a side view of the gripper of FIG. 1 with the hook members pushed apart.

As shown in FIGS. 4 and 5, each gripper element 6 is formed by a pair of hook members 17 whereby one of the hook members 17 is part of one of the cross beam sheets 19, and the other one of the hook members 17 is part of the other one of the cross beam sheets 19, with the two hook members 17 pointing away from one another, as best seen in FIG. 5. In a ready position of the gripper 1, the hook members 17 of each gripper element 6 are pushed together (FIG. 4) and form a tapering entry element 22, as viewed transversely to the longitudinal direction and best seen in FIG. 1, for reliable insertion into the container opening. In the ready position of the gripper 1, the hook ends 18 do not project beyond the outer contour of the pertaining hook members 17 but are covered by the hook members 17.

In the gripping position of the gripper 1, as shown in FIG. 5, the hook members 17 are pushed apart to such an extent that the shaft areas 23 of the hook members 17 of each gripper element 6 overlap one another, i.e. no gap is formed between the hook members 17 of each gripper element 6. When moving the gripper 1 from the ready position to the gripping position, and vice versa, the hook members 17 of one of the cross beam sheets 19 and the hook members 17 of the other one of the cross beam sheets 19 are thus movable in length direction of the cross beam 3 in synchronism in opposition to one another.

When the gripper 1 is placed on a container and correctly aligned, the pair of hook members 17 of each gripper element 6 enter respective container openings and are subsequently moved apart (not shown) until engaging behind a ridge (not shown) formed on the container sidewall. The hook members 17 are pushed apart until the shaft areas 23 of the hook members 17 strike against the container opening, and at the same time, the bolts 5 of the longitudinal beams 4 bear against the respective ends in the elongate holes 20, as shown in FIG. 5.

Referring again to FIG. 1, it can be seen that one of the two hook members 17 of each gripper element 6 is prolonged downwards and provided with a lug 24 by which a narrow gap between the confronting hook members 17 of each gripper element 6 is covered so as to prevent the risk of penetration of thin container walls, ribs, or ridges between the hook members 17 in the event the gripper 1 is placed incorrectly on the container. Suitably, the lug 24 is formed by simply bending the lower end of the respective hook member 17 inwardly by 90° and cutting the hook member 17 in this zone at an angle of 30° relative to the horizontal.

Although a preferred embodiment of the gripper 1, as described herein, has gripper elements 6 which are each comprised of two hook members 17, thereby attaining a highly reliable grabbing action, it is certainly within the scope of the present invention, to provide each cross beam sheet only with a single hook whereby the two hook members of the two cross beam sheets either confront one another or face away from one another.

While the invention has been illustrated and described as embodied in a gripper of a liftable and lowerable load-carrying apparatus for grabbing containers from above, it is not intended to be limited to the details shown since various modifications and structural changes may be made without departing in any way from the spirit of the present invention.

What is claimed as new and desired to be protected by Letters Patent is set forth in the appended claims:

1. A gripper for use with a height-adjustable load-carrying apparatus for a container, comprising a frame placed from above onto a container and having spaced-apart cross beams, each said cross beam defining a longitudinal direction and having at least two gripper elements spaced from one another at a distance which is greater than a length of each of the gripper elements, with each gripper element depending from the cross beam for insertion through a container opening when the frame is placed on the container, each said cross beam being made of two sheets which are movable relative to one another in the longitudinal direction, with one of the sheets having one of the gripper elements and the other one of the sheets having the other one of the gripper elements, with the two gripper elements movable in opposite direction to one another in the longitudinal direction of the beam between a ready position and a gripping position, wherein each of the sheets has an opening for receiving a bolt in a direction transversely to the longitudinal direction, and an elongate hole spaced from the opening in longitudinal direction, with the bolt received in the opening of one of the sheets and engaging the elongate hole of the other one of the sheets.

2. The gripper of claim 1 wherein the cross beam has a length which is variable by adjusting the two sheets relative to one another in synchronism for moving the gripper elements between the gripping and ready positions.

3. The gripper of claim 1 wherein each of the gripper elements has two hook members, with one of the hook members being located on one of the sheets and the other one of the hook members being located on the other one of the sheets.

4. The gripper of claim 3 wherein the hook members of each gripper element point away from one another.

5. The gripper of claim 3 wherein the hook members of each gripper element overlap one another in a direction transversely to the longitudinal direction when the gripper element is in the gripping position and the hook members are moved apart.

6. The gripper of claim 3 wherein the one hook member is formed in one piece with the one sheet, and the other hook member is formed in one piece with the other sheet.

7. The gripper of claim 6 wherein the sheets and the hook members are made by cutting from sheet metal.

8. The gripper of claim 7 wherein the sheets and the hook members are made from sheet metal through a laser cutting process.

9. The gripper of claim 3 wherein one of the hook members of each gripper element has a lower end configured to cover a gap formed between the hook members.

10. The gripper of claim 3 wherein the hook members of each gripper element so cover one another, when the gripper element is in the ready position and the hook members are pushed together, as to form a downwardly tapered entry element, viewed transversely to the longitudinal direction, for insertion into the container opening.

11. The gripper of claim 1 wherein the frame includes longitudinal beams which are interconnected by the cross beams and have ends for receiving the bolts.

12. The gripper of claim 11 wherein the longitudinal beams extend parallel to one another, with each of the longitudinal beams being telescopically changeable in length.

13. The gripper of claim 11, and further comprising rollers rotatably mounted from outside onto the bolts for placement on a rim of the container.

14. The gripper of claim 1, wherein the opening is circular.

* * * * *